US006964271B2

(12) United States Patent
Andrews

(10) Patent No.: US 6,964,271 B2
(45) Date of Patent: Nov. 15, 2005

(54) BOW SUSPENSION SYSTEM

(76) Inventor: Albert A. Andrews, 423 Old Tasso Pl., Cleveland, TN (US) 37312

( * ) Notice: Subject to any disclaimer, the term of this patent is extended or adjusted under 35 U.S.C. 154(b) by 80 days.

(21) Appl. No.: 10/361,333

(22) Filed: Feb. 10, 2003

(65) Prior Publication Data

US 2003/0168051 A1 Sep. 11, 2003

Related U.S. Application Data

(60) Provisional application No. 60/425,960, filed on Nov. 13, 2002, provisional application No. 60/425,899, filed on Nov. 13, 2002, provisional application No. 60/418,098, filed on Oct. 11, 2002, provisional application No. 60/418,092, filed on Oct. 11, 2002, provisional application No. 60/355,574, filed on Feb. 8, 2002, provisional application No. 60/355,582, filed on Feb. 8, 2002, and provisional application No. 60/355,583, filed on Feb. 8, 2002.

(51) Int. Cl.[7] ..... F41B 7/00
(52) U.S. Cl. ..... 124/25.6; 124/89; 267/153
(58) Field of Search ..... 124/25.6, 89, 23.1, 124/88, 86; 267/153, 141.2

(56) References Cited

U.S. PATENT DOCUMENTS

| | | | | |
|---|---|---|---|---|
| 4,644,929 | A | | 2/1987 | Peck |
| 4,756,296 | A | | 7/1988 | Darlington |
| 5,678,529 | A | * | 10/1997 | Larson ..... 124/25.6 |
| 5,722,380 | A | | 3/1998 | Land et al. |
| 5,809,982 | A | | 9/1998 | McPherson |
| 5,934,265 | A | * | 8/1999 | Darlington ..... 124/25.6 |
| 5,960,778 | A | * | 10/1999 | Larson ..... 124/25.6 |
| 5,967,132 | A | | 10/1999 | Loomis |
| 5,996,567 | A | | 12/1999 | McPherson |
| 6,112,732 | A | * | 9/2000 | Larson ..... 124/25.6 |
| RE37,544 | E | * | 2/2002 | Darlington ..... 124/25.6 |
| 6,415,780 | B1 | | 7/2002 | Proctor |
| 6,446,619 | B1 | | 9/2002 | McPherson |
| 6,474,324 | B1 | | 11/2002 | Despart et al. |
| 6,543,432 | B2 | * | 4/2003 | Andrews et al. ..... 124/23.1 |
| 6,629,522 | B2 | * | 10/2003 | Andrews ..... 124/25.6 |
| 2002/0078939 | A1 | * | 6/2002 | Andrews et al. ..... 124/10 |
| 2002/0096159 | A1 | | 7/2002 | McPherson |
| 2002/0144675 | A1 | | 10/2002 | Lommasson et al. |
| 2002/0166550 | A1 | | 11/2002 | Andrews |

* cited by examiner

*Primary Examiner*—Derris H. Banks
*Assistant Examiner*—Urszula M. Cegielnik
(74) *Attorney, Agent, or Firm*—Clark Hill PLC

(57) ABSTRACT

A suspension system is provided for dampening vibrational energy and noise in an archery bow. The suspension system includes a limb including an axle clearance hole extending axially therethrough, an axle shaft extending through the axle clearance hole, and a bushing seated within the axle clearance hole for rotatably receiving the axle shaft therethrough. In addition, the suspension system includes a dampening member positioned and extending radially between the bushing and the limb for decoupling the axle shaft from the limb and dampening vibrational energy exerted through the axle shaft.

50 Claims, 17 Drawing Sheets

BOW SUSPENSION SYSTEM

CROSS-REFERENCE TO RELATED APPLICATIONS

This application claims priority to and the benefit of U.S. Provisional Patent Application Ser. No. 60/355,574, filed Feb. 8, 2002; U.S. Provisional Patent Application Ser. No. 60/355,582, filed Feb. 8, 2002; U.S. Provisional Patent Application Ser. No. 60/355,583, filed Feb. 8, 2002; U.S. Provisional Patent Application Ser. No. 60/418,092, filed Oct. 11, 2002; U.S. Provisional Patent Application Ser. No. 60/418,098, filed Oct. 11, 2002; U.S. Provisional Patent Application Ser. No. 60/425,899, filed Nov. 13, 2002; and U.S. Provisional Patent Application Ser. No. 60/425,960, filed Nov. 13, 2002.

BACKGROUND OF THE INVENTION

1. Field of the Invention

This invention relates to an archery bow. More particularly, the invention relates to a suspension system for dampening vibrational energy and noise in an archery bow.

2. Description of the Related Art

Archery bows are typically utilized by individuals participating in hunting or recreational archery. In each of these activities, the ability to control the exact location to which the arrow is shot is essential. At the same time, the drawing back of the string and subsequent release creates vibrational energy throughout the bow, especially in the strings and the limbs. This vibrational energy substantially interferes with one's ability to control the bow. Thus, a system that reduces vibrational energy is a highly desirable feature for a bow.

Various systems have been developed in an attempt to reduce or eliminate vibrations throughout a compound bow. For example, U.S. Pat. No. 6,415,780 to Proctor is directed to a bearing system for a compound bow. The bearing system includes a sealed ball bearing assembly and a bearing support element. A cam is mounted along an axle. The axle is supported on opposite sides of the cam by the ball bearing assembly. The ball bearing assemblies are received in bores formed in limb tip overlays. The limb tip overlays are secured to limb tips by an adhesive. Alternatively, a hole in the limb blank may be created to support the ball bearing assemblies. The ball bearing assemblies reduce rotational friction and enhance lateral stability of the cam.

In addition, U.S. patent application Publication No. 2002/0166550 discloses an archery bow cam including a dead blow assembly fitted within a coil spring. The dead blow assembly, which includes a dead blow element and two damping elements, dampens cam vibrations at the end of a bow shot.

SUMMARY OF THE INVENTION

A suspension system is provided for dampening vibrational energy and noise in an archery bow. The suspension system includes a limb including an axle clearance hole extending axially therethrough, an axle shaft extending through the axle clearance hole, and a bushing seated within the axle clearance hole for rotatably receiving the axle shaft therethrough. In addition, the suspension system includes a dampening member positioned and extending radially between the bushing and the limb for decoupling the axle shaft from the limb and dampening vibrational energy exerted through the axle shaft.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
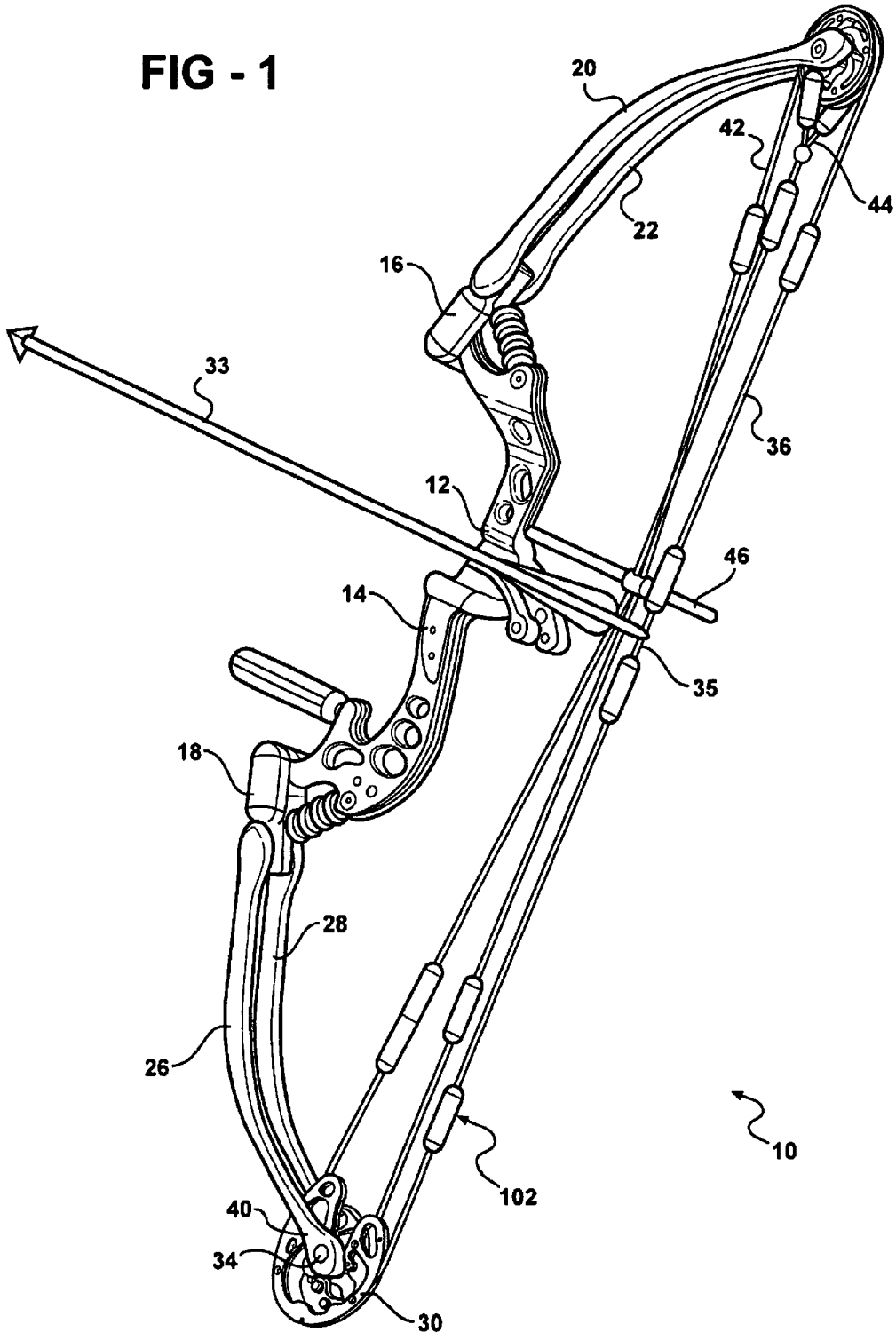
FIG. 1 is a perspective view of a bow.

Referring to FIG. 1, an archery bow, generally shown at 10, includes a handle or riser 12, a grip 14, and limb pockets 16, 18 secured to the riser 12. Although a compound bow is shown in FIG. 1, it is contemplated that the following description is equally applicable to other bows including, but not limited to, cross bows and recurve bows. The bow 10 includes a pair of upper limbs 20, 22 extending between the limb pocket 16 and a rotating member or wheel 24. A pair of lower limbs 26, 28 extends between the limb pocket 18 and a rotating member or cam 30. The wheel 24 and the cam 30 are each rotatably mounted on a respective axle shaft 32, 34. The axle shaft 32 extends between the upper limbs 20, 22, and the axle shaft 34 extends between the lower limbs 26, 28.

A string 36 extends from a distal end 38 of the upper limbs 20, 22 to a distal end 40 of the lower limbs 26, 28. More specifically, one end of the string 36 extends around the wheel 24 and the other end of the string 36 extends around the cam 30. A drawstring portion 35 of the string 36 is drawn away from the riser 10, which causes the distal ends 36, 40 of the limbs 20, 22, 26, 28 to flex inwardly. As a result, energy is stored within the limbs 20, 22, 26, 28. This stored energy is released when the drawstring portion 35 of the string 36 is released to shoot an arrow 33. A regular harness 42 and a split harness 44 also extend between the wheel 24 and the cam 30. A cable guard rod 46 extends between the riser 12 and the string 36.

Figure 2:
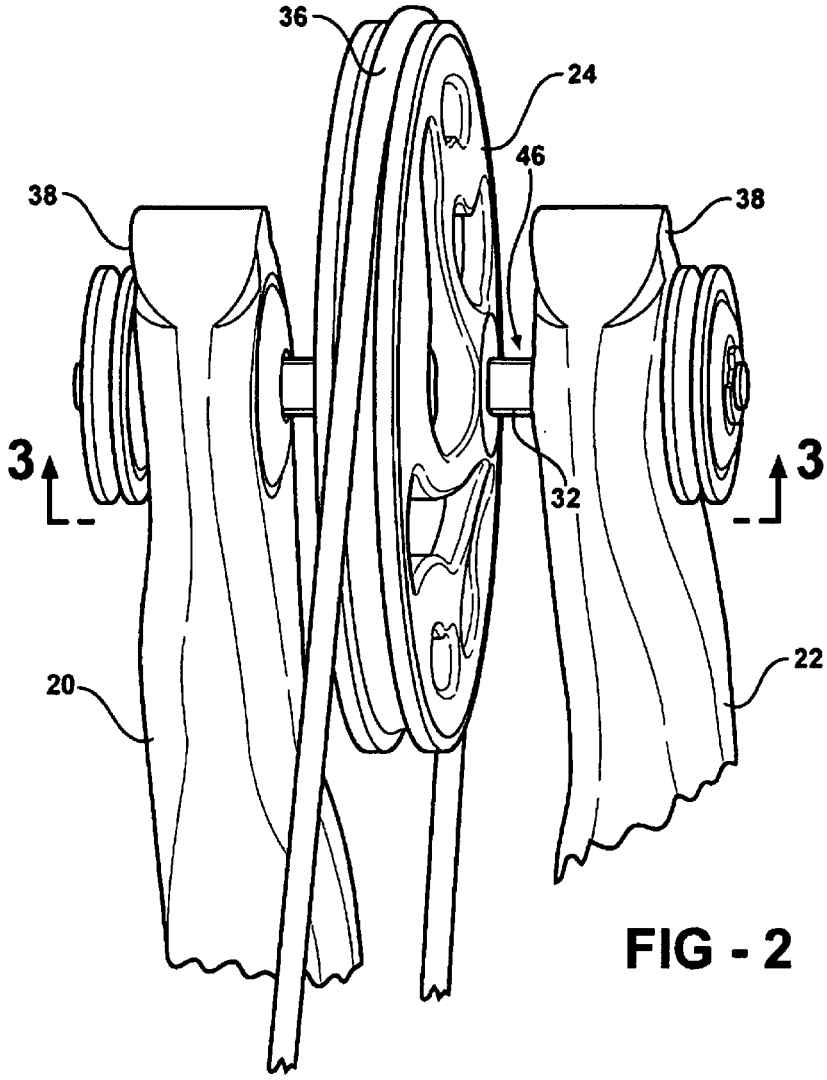
FIG. 2 is a fragmentary perspective view of the bow including a suspension system according to the invention.
Figure 3:
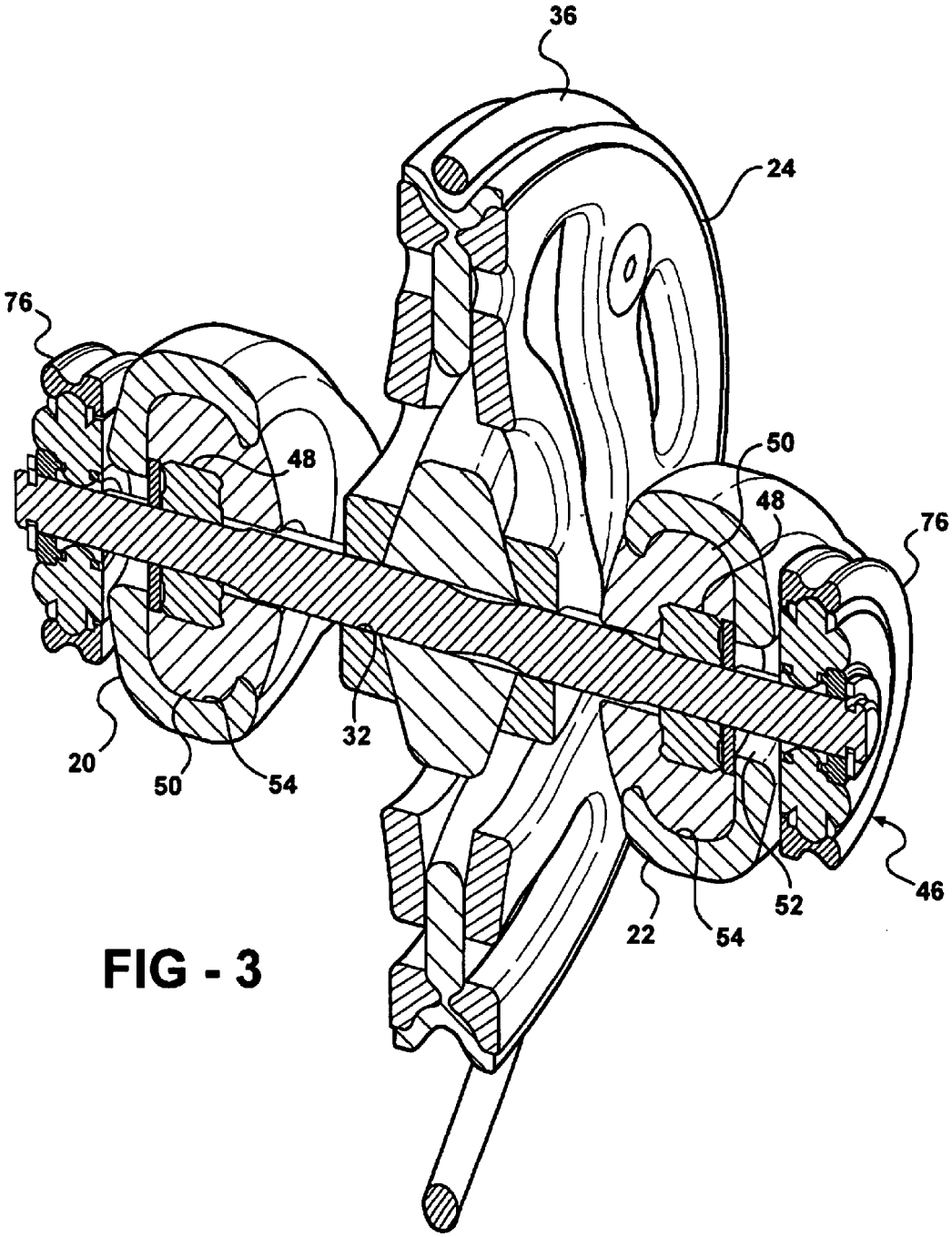
FIG. 3 is a cross-sectional view taken along line 3—3 in FIG. 2.
Figure 5:
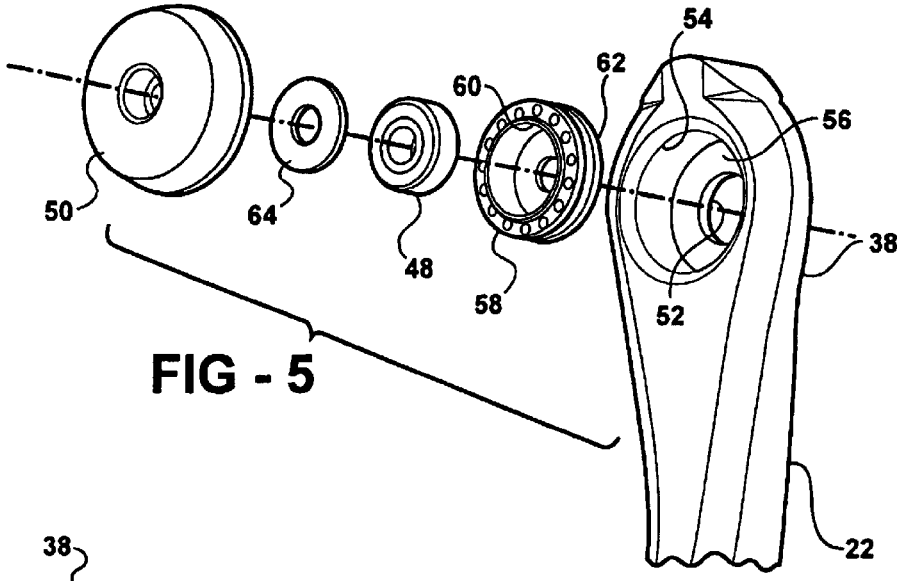
FIG. 5 is an exploded perspective view of an interlocking hub, a ball bearing, a dampening material for positioning within the limb.
Figure 6:
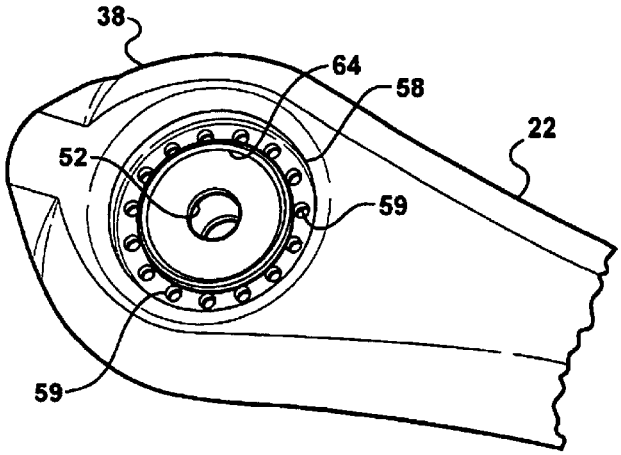
FIG. 6 is a perspective view of the limb having the interlocking hub and the ball bearing positioned within a recessed portion.
Figure 7:
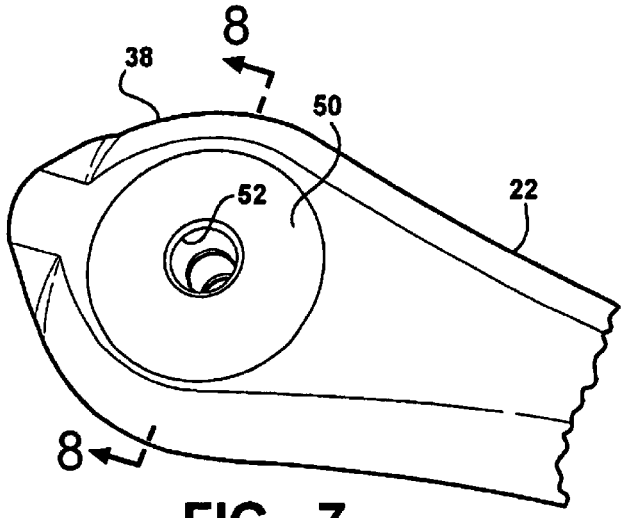
FIG. 7 is a perspective view of the limb showing a spacer covering the ball bearing.
Figure 8:
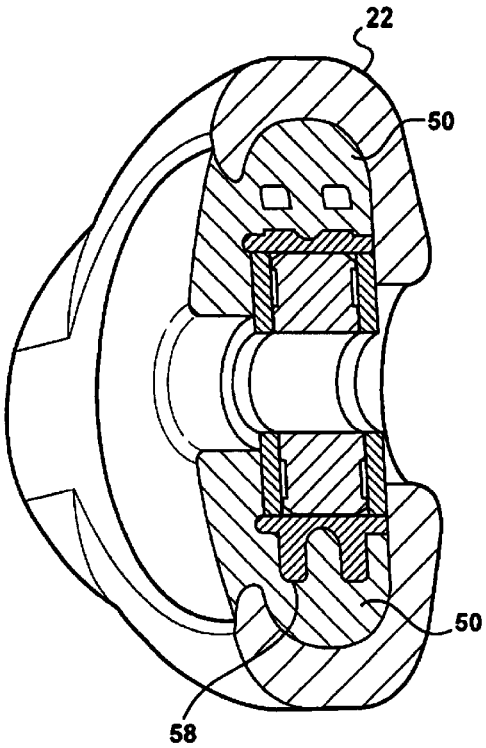
FIG. 8 is a cross-sectional view taken along line 8—8 of FIG. 7.

Referring to FIGS. 2 and 3, a suspension system, generally shown at 46, for the bow 10 includes one of the upper limbs 22, the axle shaft 32, a bushing or ball bearing 48 mounted along the axle shaft 32, and a dampening member 50 extending outwardly from the bushing 48 and positioned between the bushing 48 and the upper limb 22. It will be appreciated that although the suspension system 46 is shown with regards to one of the upper limbs 22, the suspension system 46 applies equally to the other upper limb 20 and the lower limbs 26, 28. The suspension system 46 is also rigid enough to support the bow 10. As a result, the suspension system 46 is able to store kinetic energy, to dissipate shock, and to increase bow speed.

The dampening member 50 is an elastomeric material including thermoplastic elastomers. In a preferred embodiment, the dampening member 50 is formed from urethane. The dampening member 50 may also be a spring, a spring washer, or an incompressible fluid. The dampening member 50 decouples the axle shaft 32 from the upper limb 22 so that the axle shaft 32 floats freely relative thereto. In addition, the dampening member 50 absorbs vibrational energy exerted through the axle shaft 32.

Figure 4:
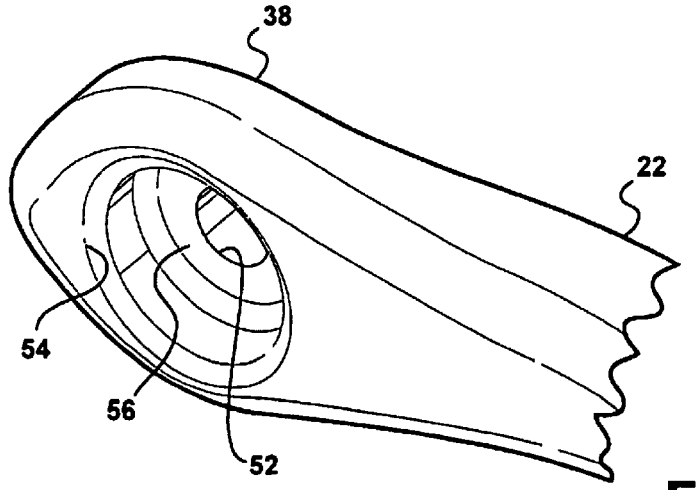
FIG. 4 is a perspective view of a limb including an axle clearance hole extending therethrough.

Referring to FIG. 4, the limb 22 includes an axle clearance hole 52 extending axially therethrough at the distal end 38. The axle clearance hole 52 defines a recessed portion 54 having a flat seating surface 56. The axle shaft 32 extends through the axle clearance hole 52, including the recessed portion 54 thereof, for mounting the limb 22 along the axle shaft 32, as shown in FIG. 3.

The placement of the dampening member 50 and the ball bearing 48 within the recessed portion 54 can be accomplished in different ways. Referring to FIGS. 5 through 8, an interlocking hub 58 includes an inner cavity 60 and an outer groove 62. The ball bearing 48 is inserted into the inner cavity 60. A spacer 64 is then secured to the interlocking hub 58 to cover the ball bearing 48. The interlocking hub 58 is inserted into the recessed portion 54. Finally, the elastomeric material is injected into the recessed portion 54. The elastomeric material flows through hub apertures 59 and into the outer groove 62 to form the dampening member 50. The outer groove 62 interlocks the dampening member 50 to retain the dampening member 50 within the recessed portion 54. In addition, the dampening member 50 is molded to the limb 22.

Figure 9:
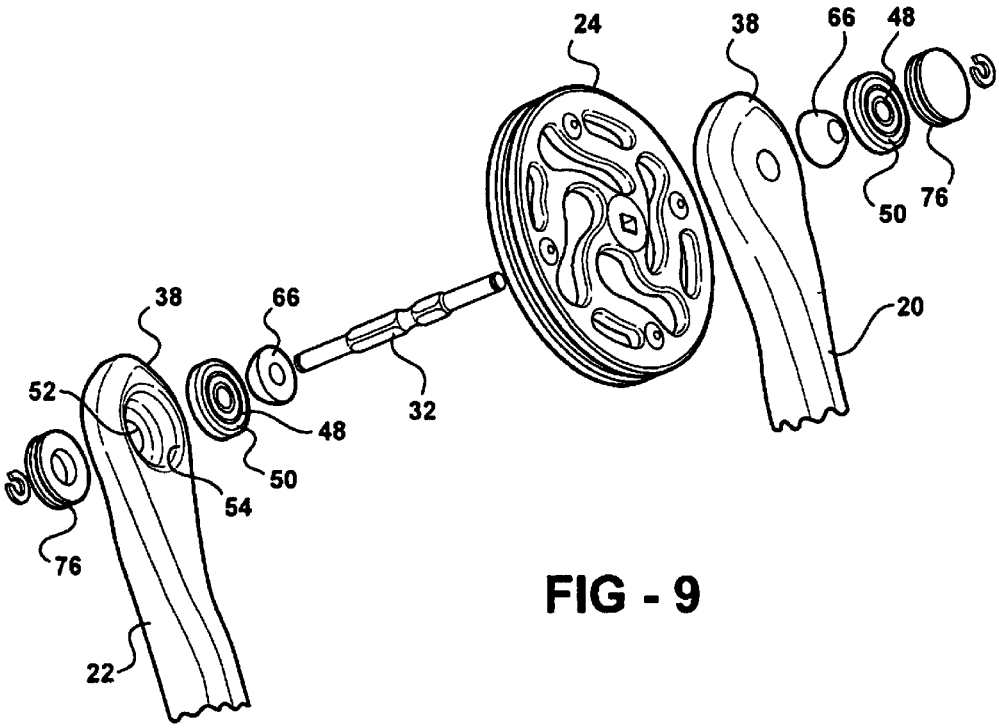
FIG. 9 is an exploded perspective view of the suspension system according to the invention.
Figure 10:
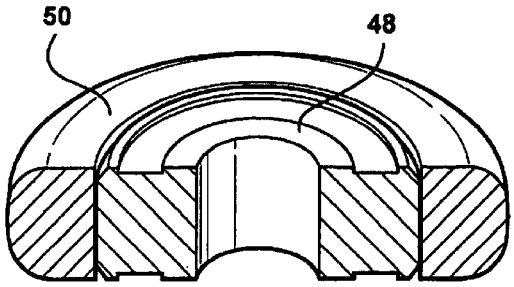
FIG. 10 is a sectional view of a ball bearing having a dampening material molded thereto.
Figure 11:
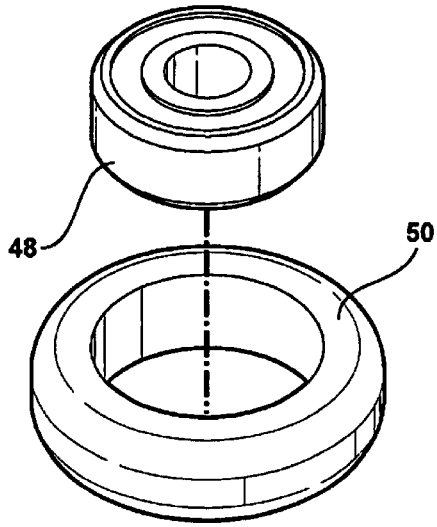
FIG. 11 is an exploded perspective view of the ball bearing and the dampening material.

Referring to FIGS. 9 through 11, the ball bearing 48 and the dampening member 50 are molded together away from the upper limb 22 and then press fit into the recessed portion 54 of the upper limb 22. A plurality of axle spacers 66 are mounted along the axle shaft 32 and are positioned between the rotating member 24 and each of the upper limbs 20, 22.

Figure 12:
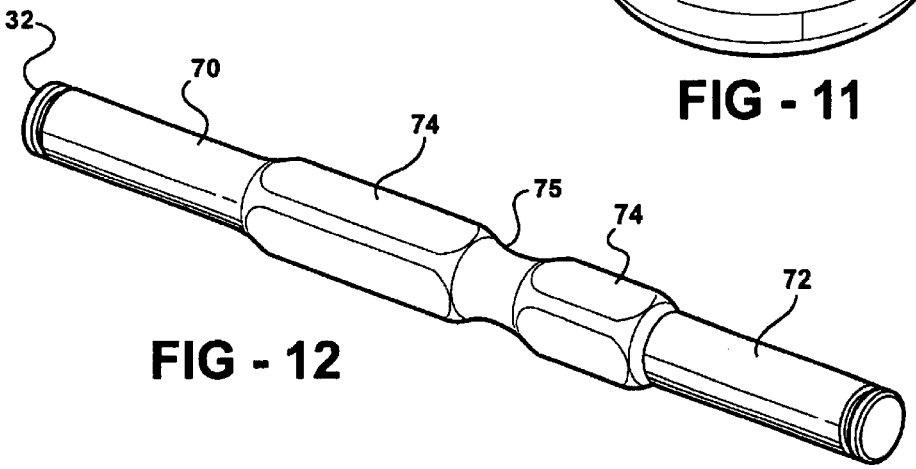
FIG. 12 is a perspective view of an axle shaft of the suspension system.
Figure 13:
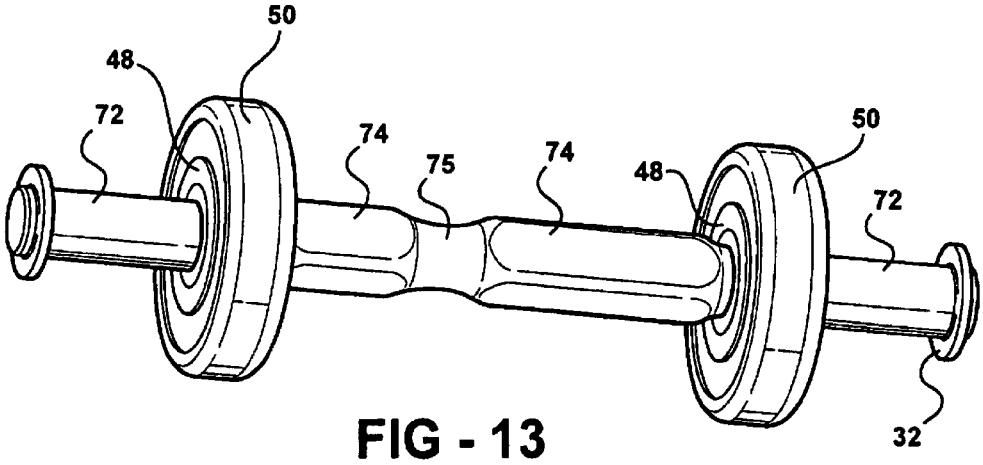
FIG. 13 is a perspective view of the axle shaft including the ball bearing with the dampening material molded thereto.
Figure 14:
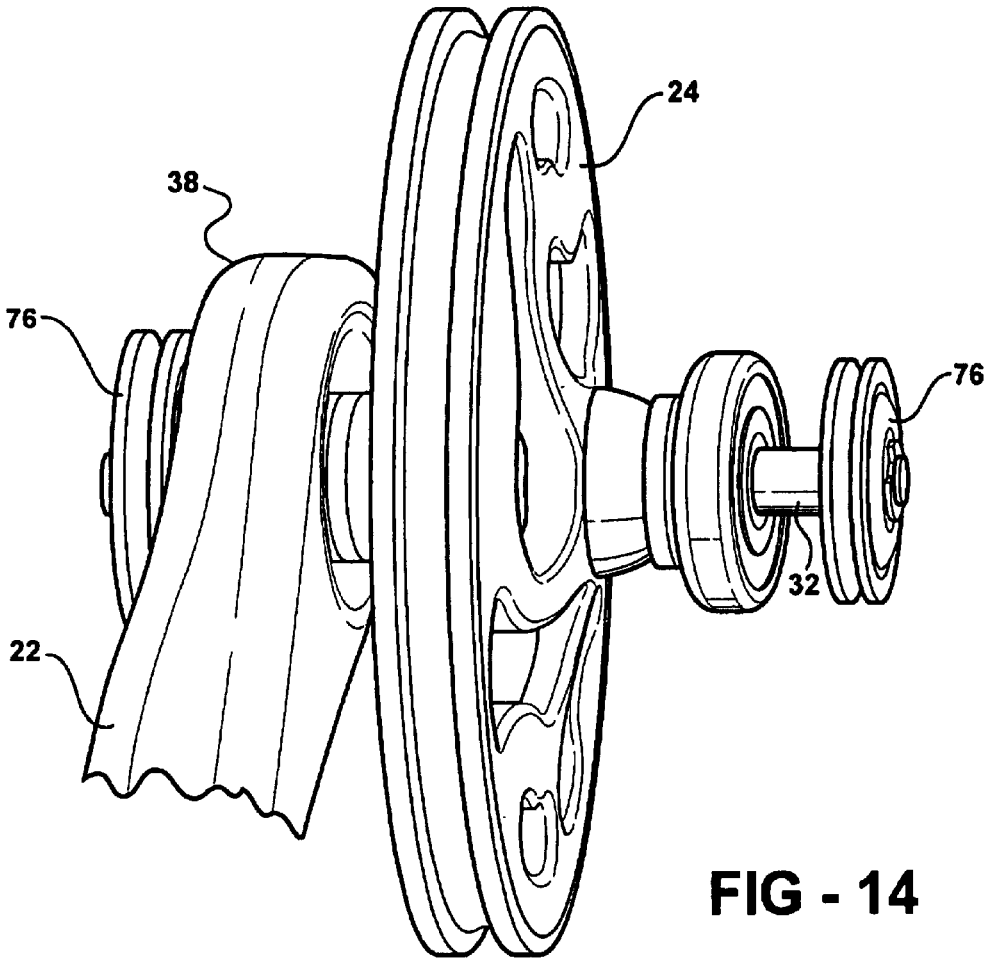
FIG. 14 is a partially cut away view of the bow having pulleys mounted along the axle shaft.
Figure 15:
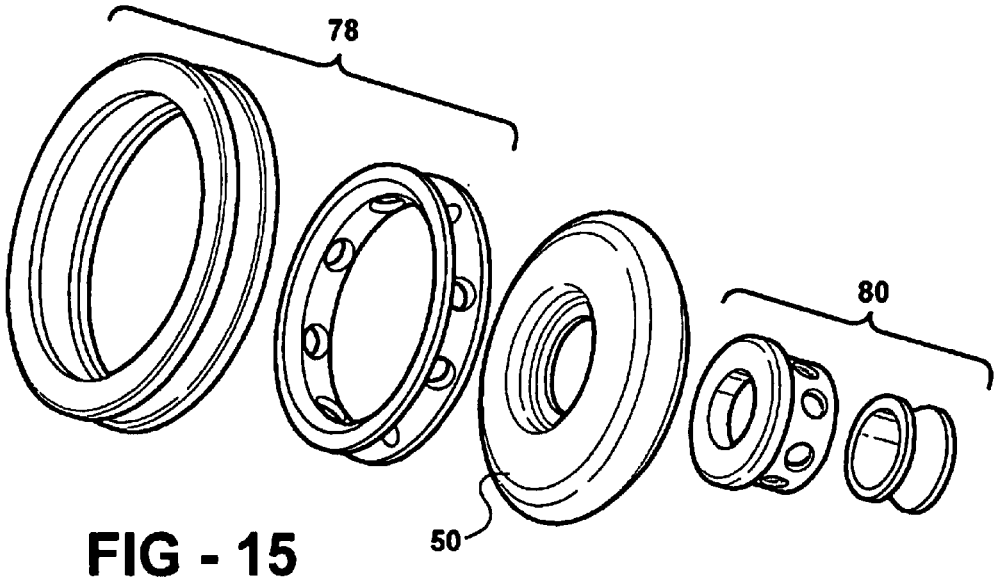
FIG. 15 is an exploded perspective view of the pulley including a two-part outer bushing and a two-part inner bushing.
Figure 16:
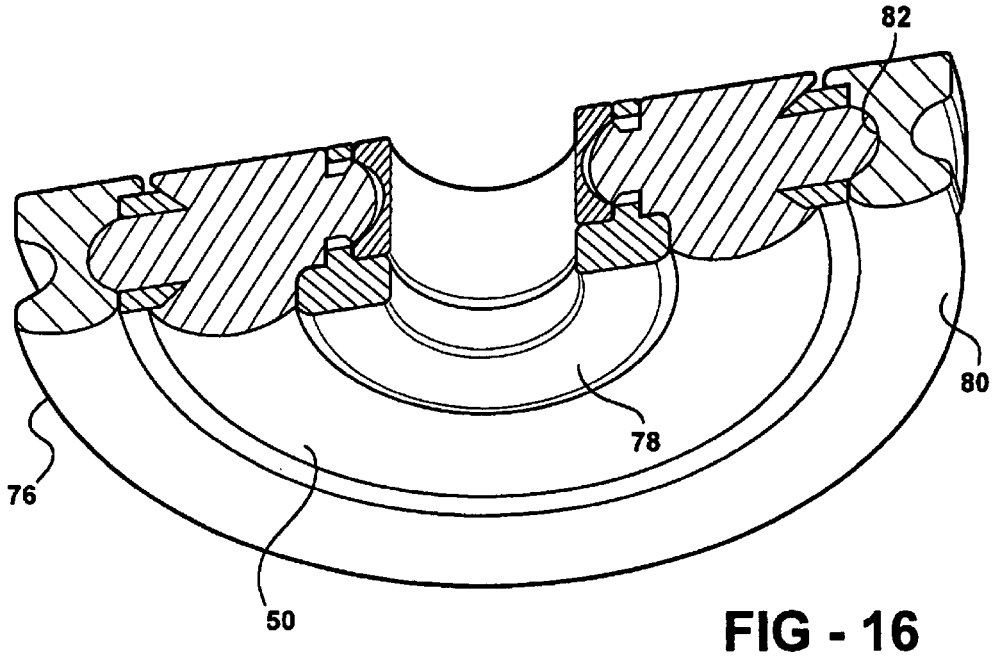
FIG. 16 is a sectional view of the pulley.

Referring to FIGS. 12 and 13, the axle shaft 32 includes circular segments 70, 72 and keyed segments 74 extending therebetween. A step 75 is located along the keyed segment 74. One of the rotating members 24, 30 is mounted along the keyed segment 74 of the axle shaft 32. The rotating member 24, 30 has an axle hole 100, shown in FIG. 3, that is shaped to complement the keyed segment 74. This allows the string 36, which extends around the rotating member 24, 30, to be closer to the axle shaft 32 to allow let off. The ball bearings 48 are mounted along the circular segments 70, 72 of the axle shaft 32, also shown in FIG. 3. The rotating member 24, 30 is mounted along the non-circular segment 74.

Referring to FIGS. 14 through 20, a pulley 76 is mounted along the axle shaft 32 and disposed adjacent the limb 20. Each pulley 76 receives the split harness 44 therealong. The pulley 76 includes a two-piece reinforcing ring or outer bushing 78, a two-piece inner bushing 80, and the dampening member 50 therebetween. It will be appreciated that although the outer bushing 78 and the inner bushing 80 are shown as being two-piece components, one or both of the outer bushing 78 and the inner bushing 80 can be formed as a one-piece component. The outer bushing provides structural support for the dampening member 50. The outer 78 and inner 80 bushings define an interlocking passage 82 that lockingly engages the dampening member 50. The dampening member 50 is thus bonded to both the outer 78 and inner 80 bushings. The pulley 76 allows the axle shaft 32 to rotate freely thereabout with little or no friction.

Figure 17:
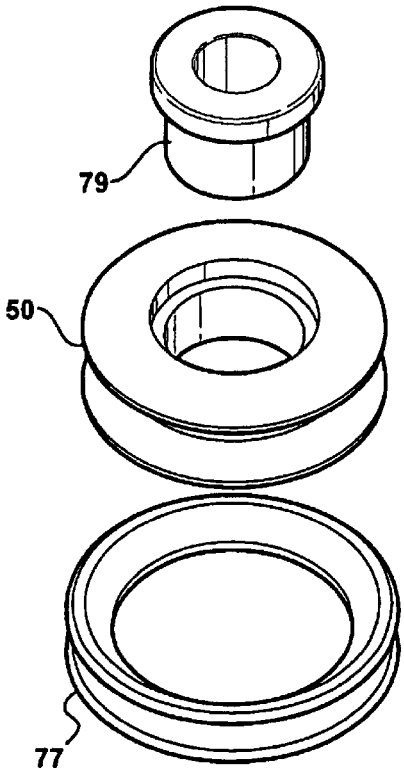
FIG. 17 is an exploded perspective view of the pulley including one-piece outer and inner bushings.
Figure 18:
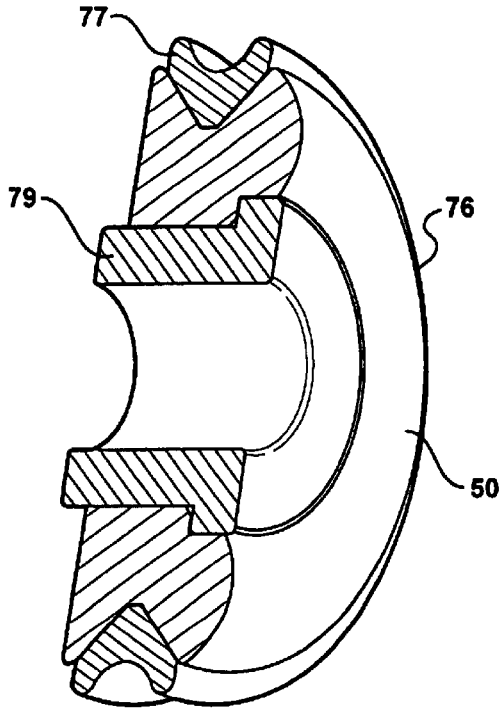
FIG. 18 is a sectional view of the pulley of FIG. 17.
Figure 19:
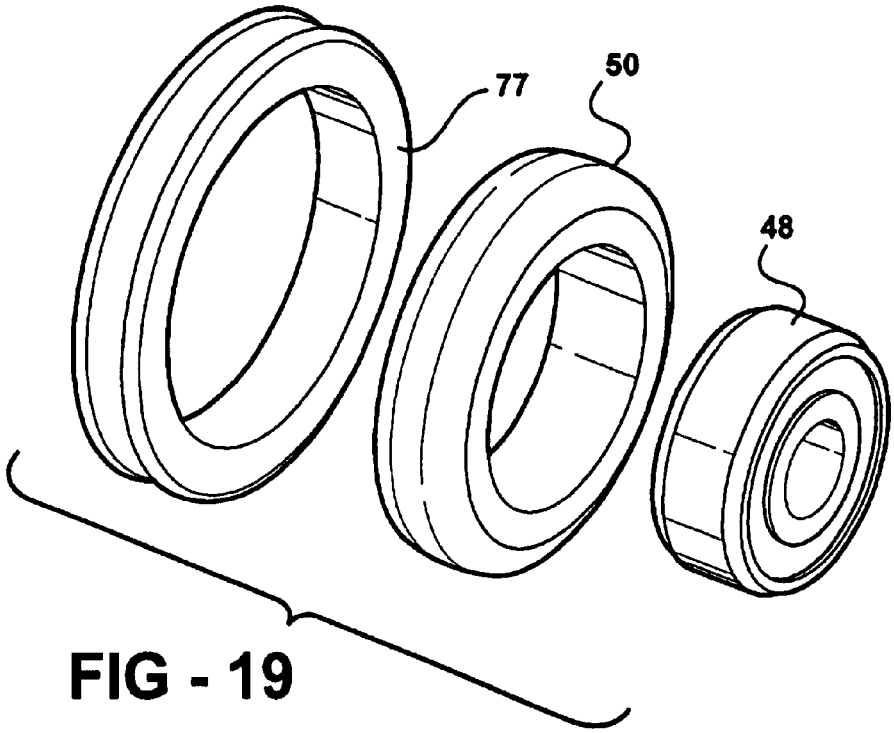
FIG. 19 is an exploded perspective view of the pulley including a ball bearing.

Referring specifically to FIGS. 17 and 18, the pulley 76 includes the dampening member 50 positioned between one-piece outer 77 and inner bushings 79 without an interlocking passage formed therebetween. Referring to FIG. 19, the pulley 76 includes the ball bearing 48 and the reinforcing ring 78 retaining the dampening member 50 therebetween.

Figure 20:
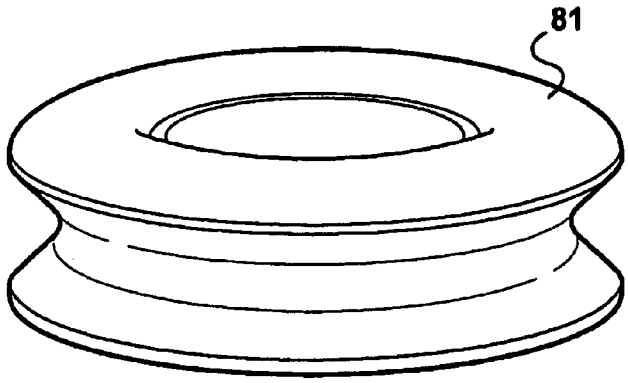
FIG. 20 is a perspective view of an elastomeric member.
Figure 21:
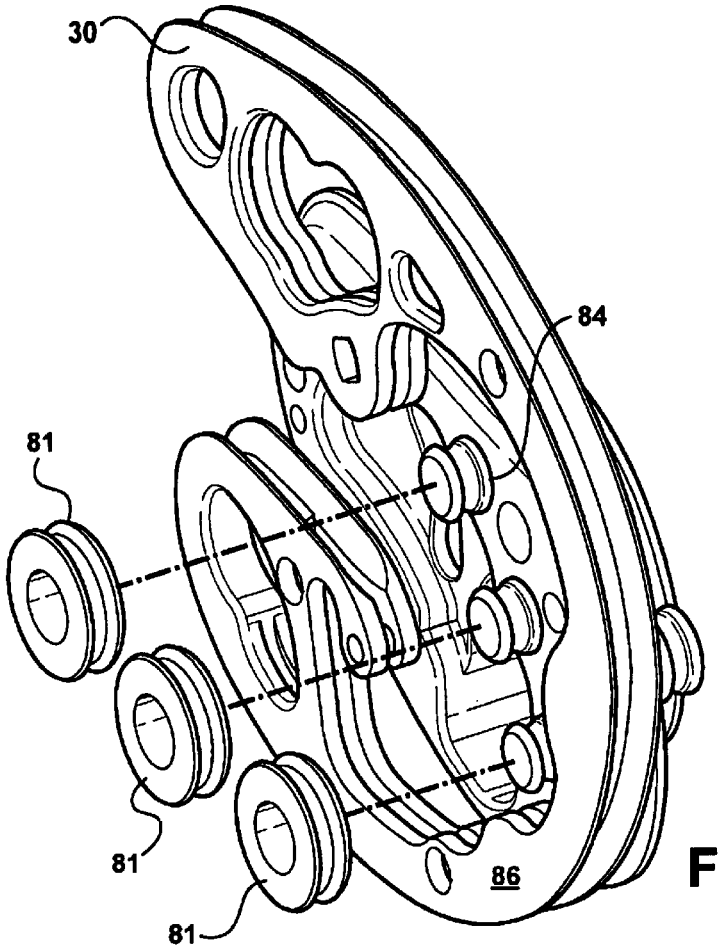
FIG. 21 is an exploded perspective view of a rotating member, a plurality of string post hookups located on the rotating member, and elastomeric members.
Figure 22:
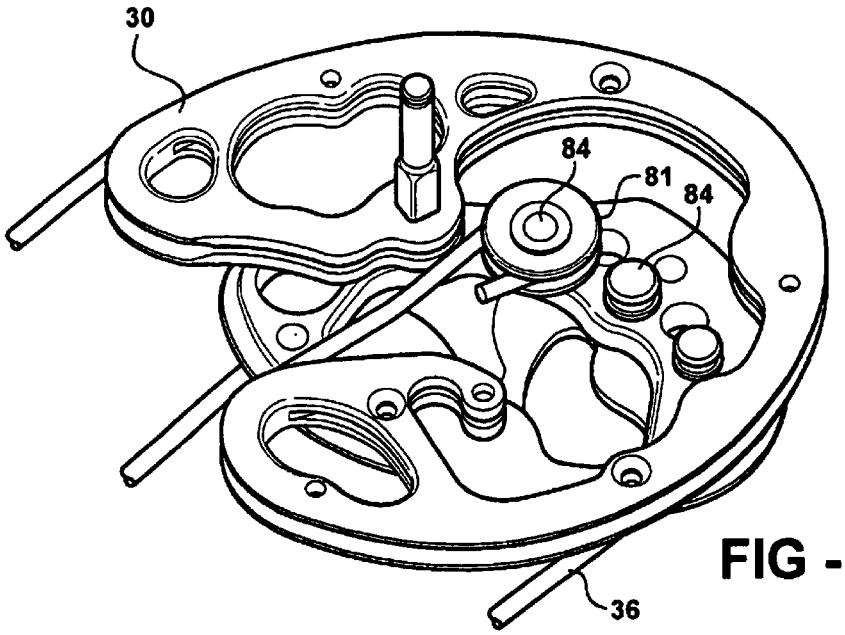
FIG. 22 is a perspective view of the elastomeric member coupled to one of the string post hookups.
Figure 23:
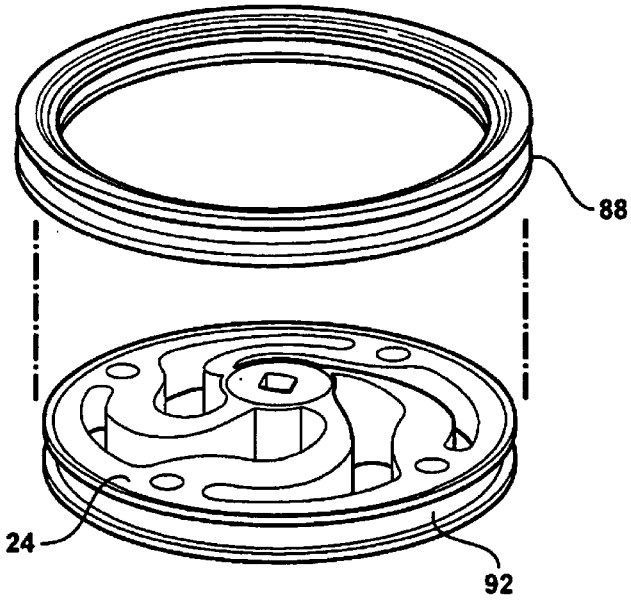
FIG. 23 is an exploded perspective view of an outer ring formed from a dampening material and a wheel.
Figure 24:
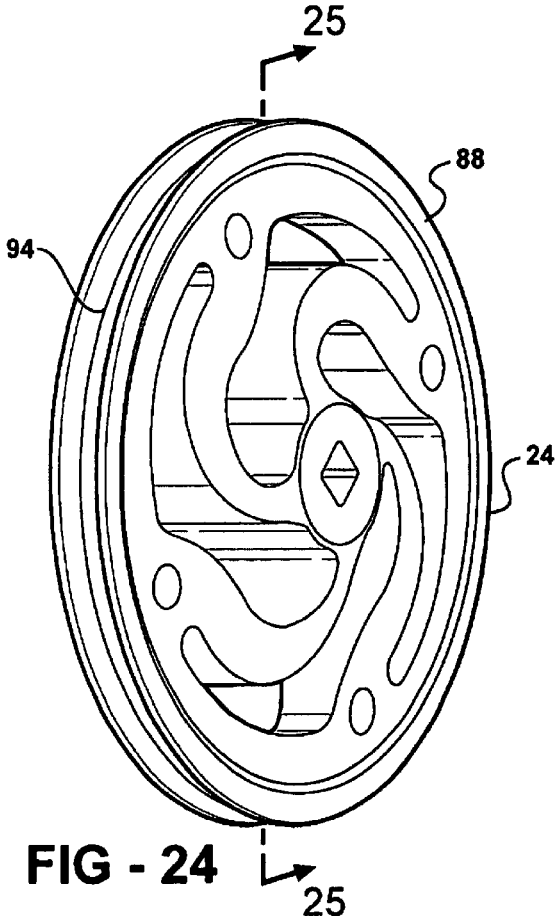
FIG. 24 is a perspective view of the outer ring molded to the wheel.
Figure 25:
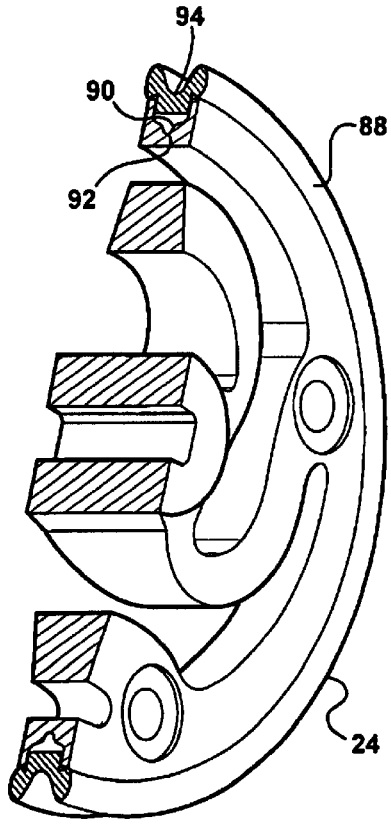
FIG. 25 is a cross-sectional view taken along line 25—25 of FIG. 24.

Referring to FIG. 20, a elastomeric member 81 is formed completely from an elastomeric material, preferably urethane. The elastomeric member 81 is generally ring-shaped. Referring to FIGS. 21 and 22, a plurality of string post hookups 84 is located along an outer surface 86 of the cam 30. The string 36 extends around the cam 30 and is secured into place by the string post hookups 84. The elastomeric member 81 is mounted to the one or more of the string post hookups 84 to dampen vibrational energy in the string 36. It will be appreciated that the pulley configurations set forth above and shown in FIGS. 15 through 19 are equally applicable to the string post hookups 84.

Referring to FIGS. 23 through 26, an outer ring 88 extends all along an outer periphery of the wheel 24. The wheel 24, which is typically formed from a metal such as aluminum, provides structural support for the outer ring 88, which is formed from an elastomeric material. The outer ring 88 includes an interlocking rim 90 interconnected to a rotating member string groove 92 for retaining the outer ring 88 to the wheel 24. The outer ring 88 further includes an outer string groove 94 for receiving the string 36. The positioning of the outer ring 88 between the wheel 24 and the string 36 decouples the wheel 24 and the string 34, and dampens vibrational energy that is exerted upon the wheel 24 when the string 36 is released to shoot the bow 10.

Figure 26:
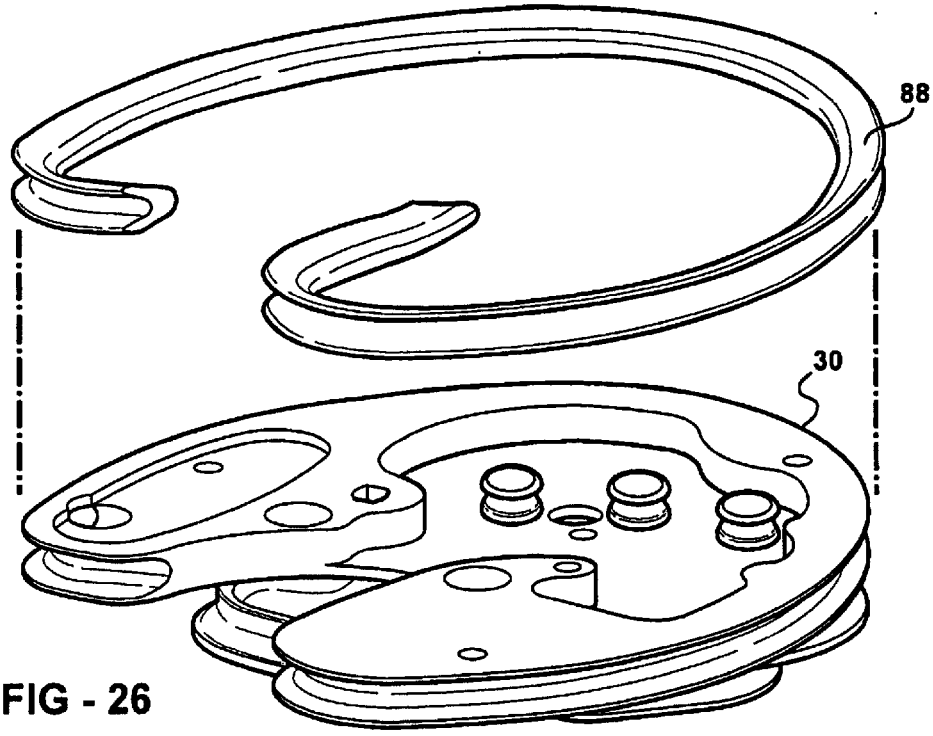
FIG. 26 is an exploded perspective view of the outer ring for stretching around the cam.

The outer ring 88 is secured to the wheel 24 by various methods including molding, bonding, stretching, and snapping into place. The assembly method chosen depends in large part upon the shape of the rotating member 24, 30. For example, when the rotating member is the cam 30, as shown in FIG. 26, it is preferable to stretch the outer ring 88 into place.

Figure 27:
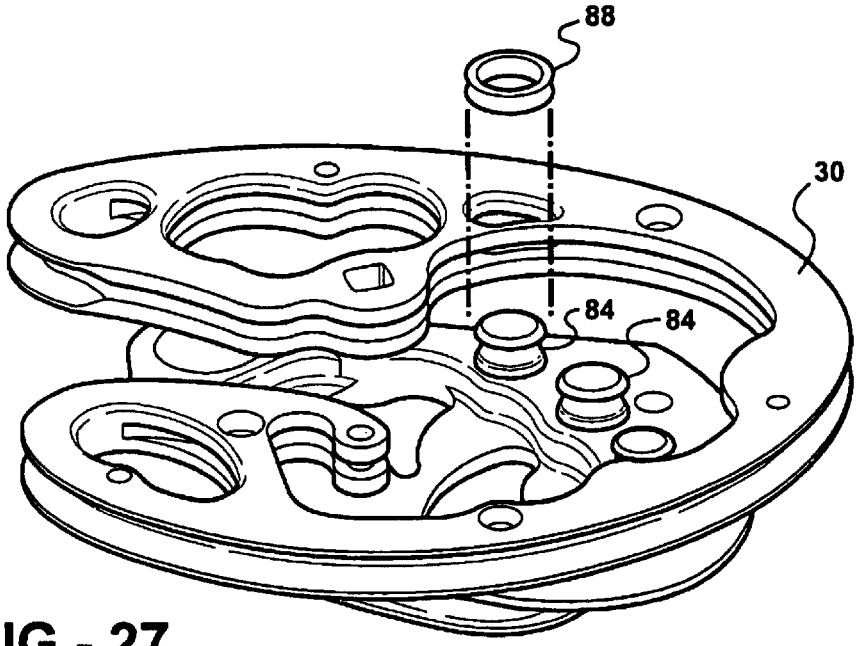
FIG. 27 is a perspective view of the rotating member and the outer ring coupled to the string post hookups.
Figure 28:
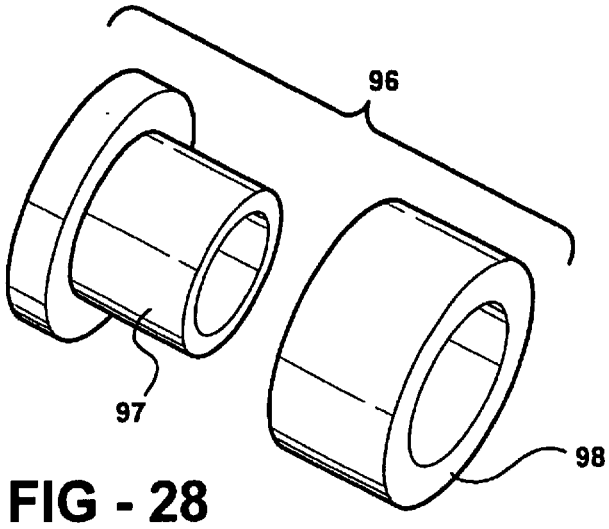
FIG. 28 is an exploded perspective view of a bushing assembly.

Referring to FIG. 27, the outer ring 88 is adapted to fit around an outer periphery of the string post hookup 84 of the cam 30. The string post hookup 84 provides structural support for the outer ring 88. The outer ring 88 may be secured to the string post hookup 84 by various methods including molding, bonding, stretching, and snapping into place.

Figure 29:
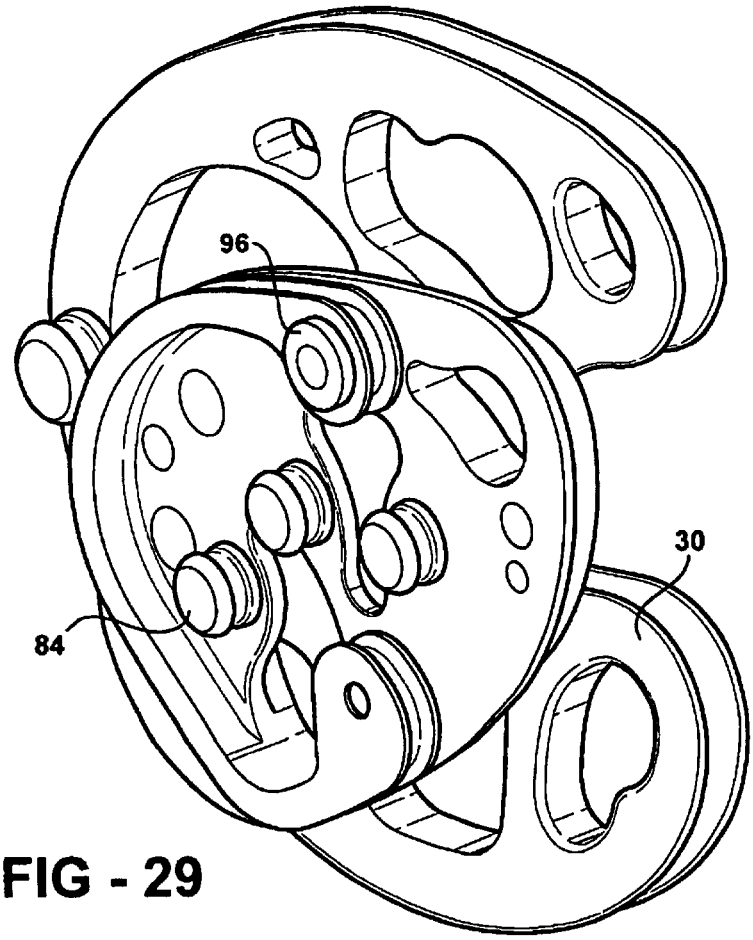
FIG. 29 is a perspective view of the bushing assembly mounted along the axle shaft within the cam.
Figure 30:
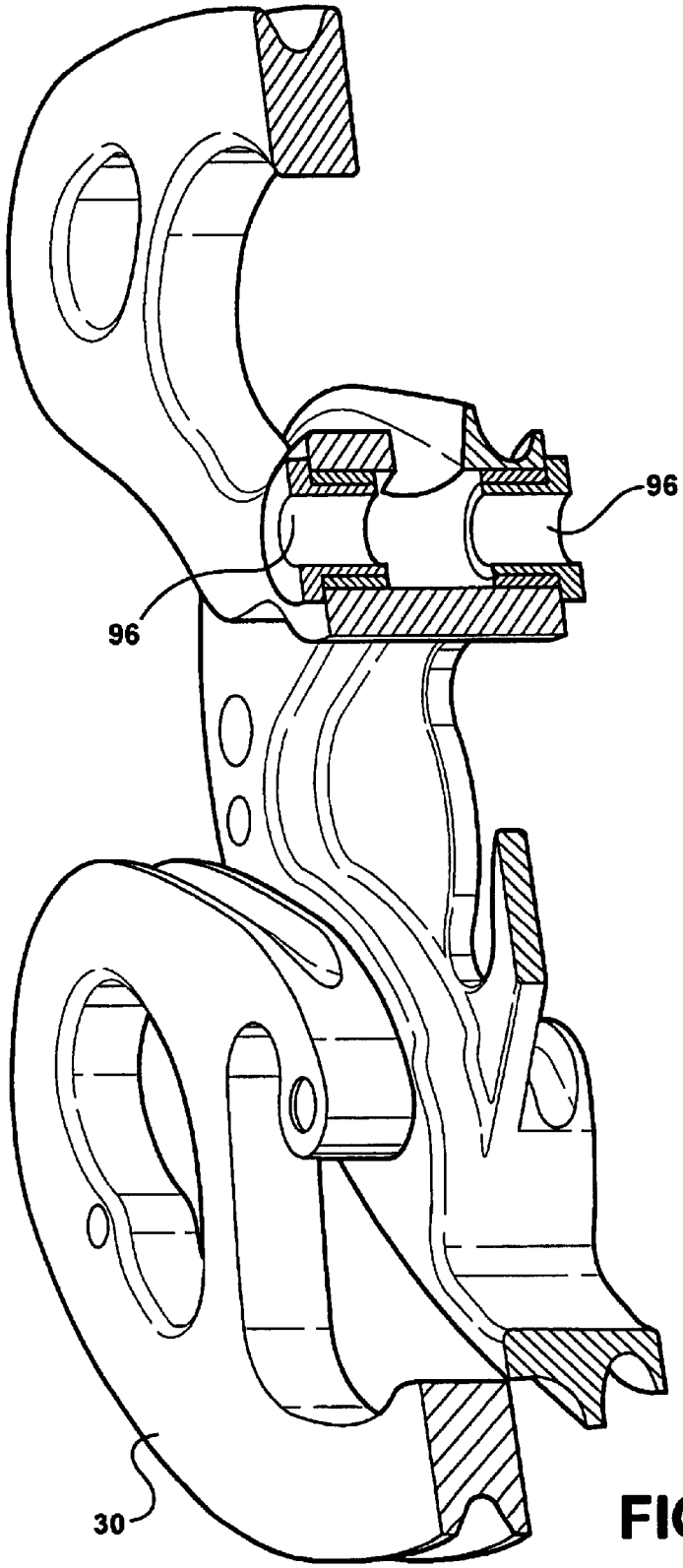
FIG. 30 is a sectional view of the cam including two of the bushing assemblies housed therewithin.
Figure 31:
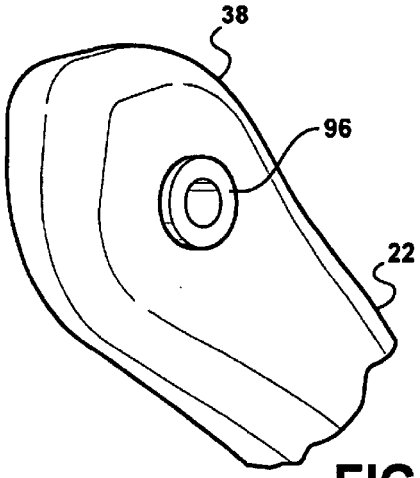
FIG. 31 is a perspective view of the bushing assembly positioned within an axle clearance hole of the limb.

Referring to FIGS. 28 through 31, a bushing suspension assembly, generally shown at 96, includes a bushing member 97 and a dampening sleeve 98. The bushing member 97 is formed from metal, plastic, or an elastomeric material, while the dampening sleeve 98 is formed from an elastomeric material. The elastomeric material includes, but is not limited to, urethane and polyurethane. Referring specifically to FIGS. 29 and 30, the bushing suspension assembly 96 is positioned within the axle hole 100 of the cam 30. Referring to FIG. 31, the bushing suspension assembly 96 is positioned within the axle clearance hole 52 of the limb 22. The bushing member 97 may be replaced with the ball bearing 48.

Figure 32:
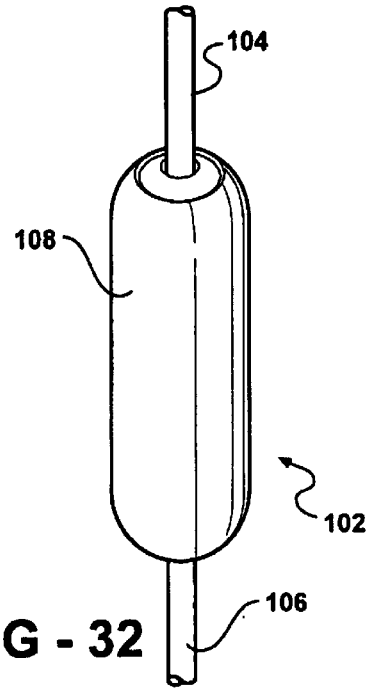
FIG. 32 is an isolated perspective view of a string shock absorber assembly interconnecting first and second strings.
Figure 33:
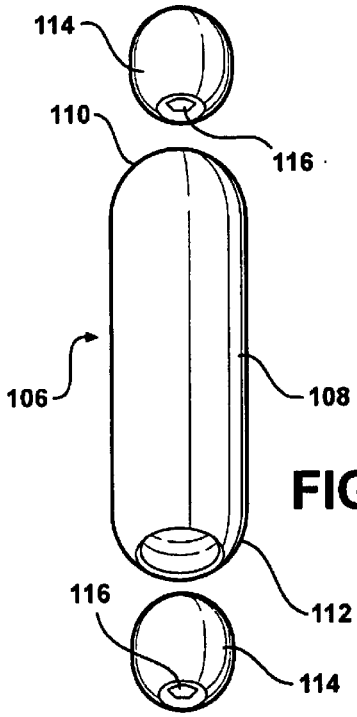
FIG. 33 is an exploded perspective view of the string shock absorber assembly.
Figure 34:
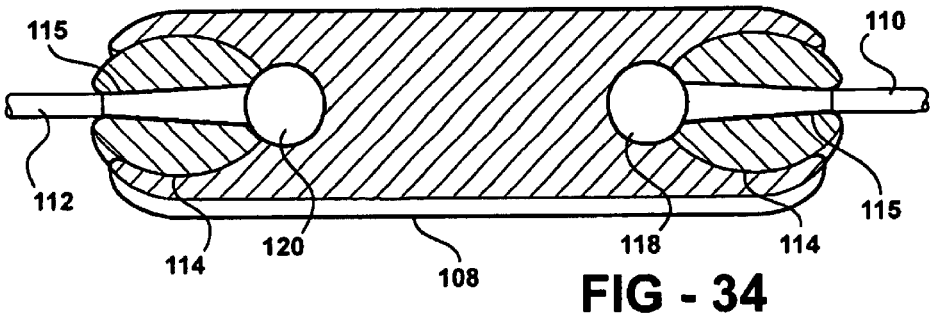
FIG. 34 is a cut away view of the shock absorber assembly.
Figure 36:
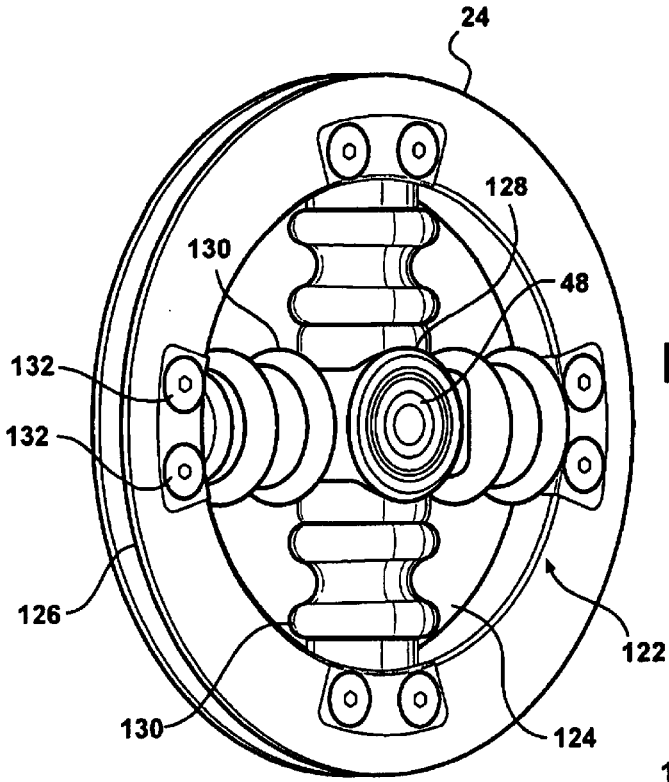
FIG. 36 is a cut away view of the wheel including an internal suspension assembly.
Figure 37:
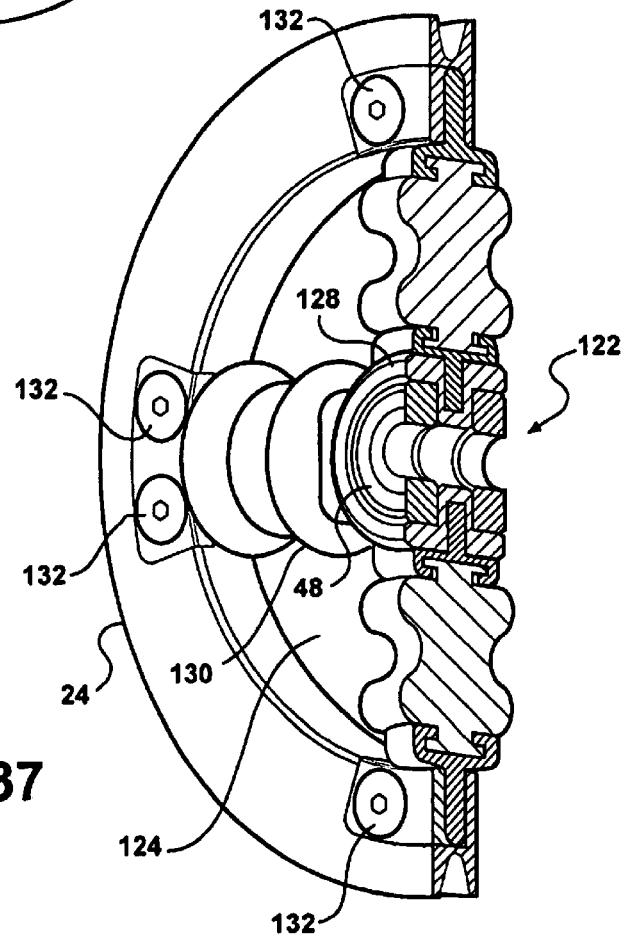
FIG. 37 is a cross-sectional view taken along line 37—37 in FIG. 36.
Figure 38:
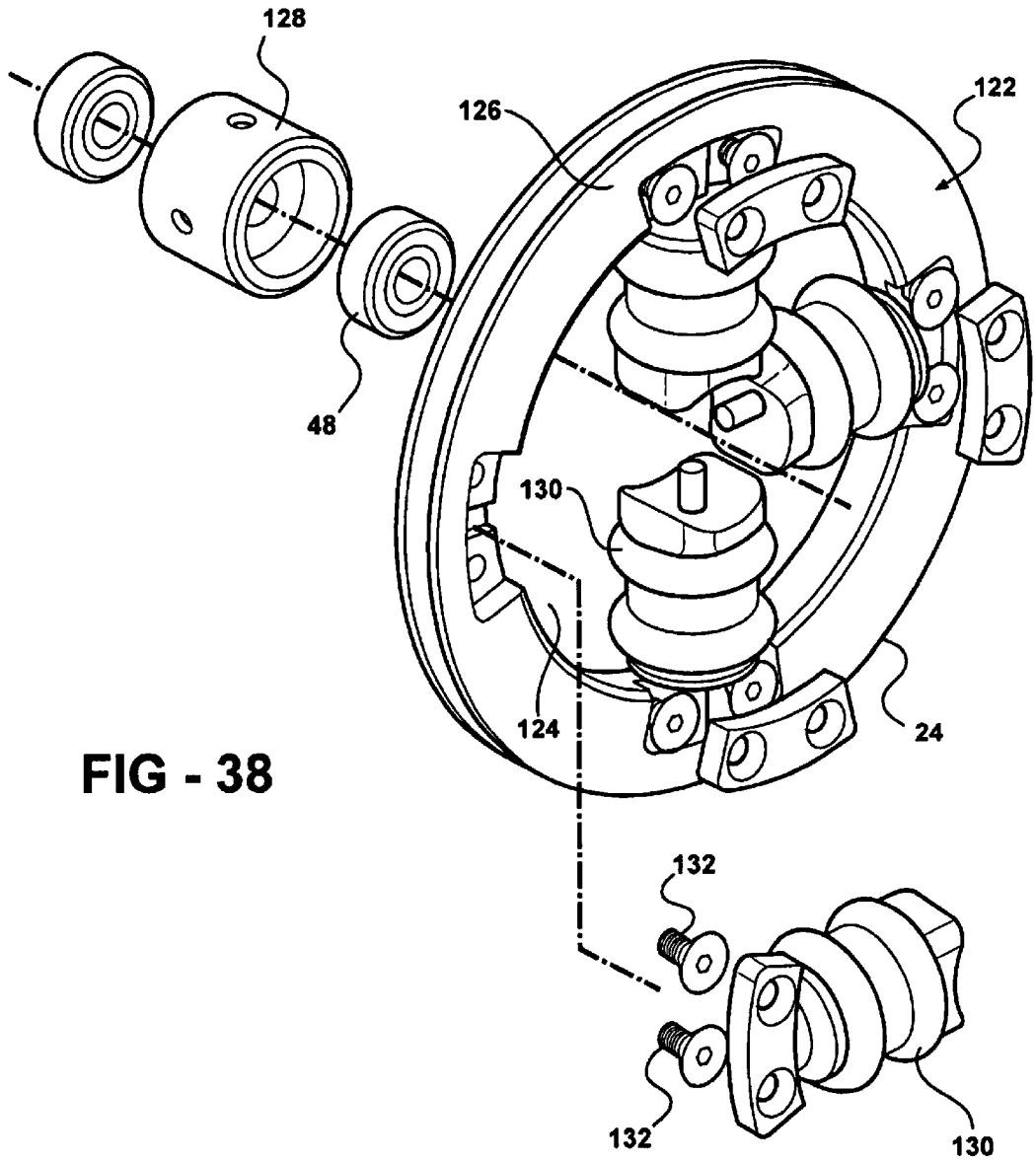
FIG. 38 is a partially exploded view of the cross-sectional view in FIG. 37.
Figure 39:
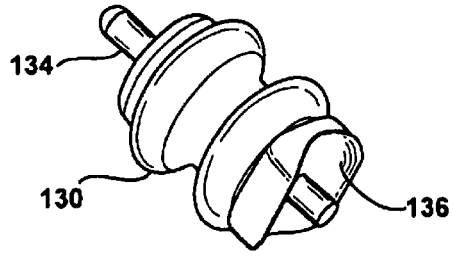
FIG. 39 is an isolated view of a dampening dowel of the internal suspension assembly.

Referring to FIGS. 32 through 34, a string shock absorber assembly, generally shown at 102, interconnects a first string 104 extending from the wheel 24 and a second string 106 extending from the cam 30, as is also shown in FIG. 1. The first string 104 extends from one of the rotating members 24, 30 while the second string 106 extends from the other of the rotating members 24, 30. The string shock absorber assembly 102 includes an elongated hollow string shock absorber 108 extending between ends 110, 112. The string shock absorber 108 is formed from an elastomeric material, such as urethane or polyurethane, so as to be able to be stretched or extended from its original length in order to store and dissipate energy. The string shock absorber assembly 102 dampens vibrational energy created in the first 104 and second 106 strings before that vibrational energy is transferred to the wheel 24 and the cam 30.

A string hookup connector 114 is mounted within the string shock absorber 108 at each of its ends 110, 112. The string hookup connector 114 includes an internal channel 116 for receiving the one of the first 104 and second 106 strings. Each internal channel 116 has a tapered end 115 for retaining one of the first 104 and second 106 strings therein. Each string hookup connector 114 is formed from metal, preferably aluminum.

The string shock absorber assembly 102 is assembled by first inserting the first string 104 one of the string hookup connectors 114 and the second string 106 into another of the string hookup connectors 114. The string hookup connectors 114, with the first 104 and second 106 strings secured therewithin, are then placed in a mold, where the string shock absorber 108 is formed so as to encapsulate the string hookup connectors 114. During the molding process, string ends 118, 120, which extend out of the string hookup connectors 114, are molded to the string shock absorber 108.

Figure 35:
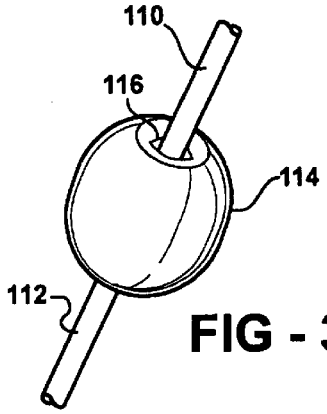
FIG. 35 is a perspective view of a string end connector interconnecting first and second strings.

Referring to FIG. 35, the string hookup connector 114 is adapted to interconnect the ends 110, 112 of the respective first 104 and second 106 strings. The string hookup connecter 114 is molded from an elastomeric material, such as urethane or polyurethane.

Referring to FIGS. 36 through 39, an internal suspension assembly 122 for the wheel 24, having an internal chamber 124 and an outer periphery 126, includes a inner housing 128, which is preferably formed from metal, generally positioned within the internal chamber 124. The ball bearing 48 is housed within the hub 128, and a plurality of dampening dowels 130 extend out from the hub 128 to the outer periphery 126 of the rotating member 24. Retainer caps 132 secure the dampening dowels 130 to the wheel 24. The dampening dowels 130 are formed from an elastomeric material including, but not limited to, urethane and polyurethane. Each of the dampening dowels 130 includes a male locking dowel base 134 and a female locking dowel base 136. The dampening dowels 130 are free to actuate within the internal chamber 124 to dampen vibrational energy in the wheel 24.

It is intended that all of the elements described above and shown in the FIGS. 1 through 39 are incorporated into a single bow to form a complete suspension system. The suspension system retains energy in the source, that is, the string 36 rather than throughout the bow 10. This retained energy is transferred to the arrow 33.

The invention has been described in an illustrative manner. It is to be understood that the terminology, which has been used, is intended to be in the nature of words of description rather than of limitation. Many modifications and variations of the invention are possible in light of the above teachings. Therefore, within the scope of the appended claims, the invention may be practiced other than as specifically described.

What is claimed is:

1. A suspension system for dampening vibrational energy and noise in an archery bow, said suspension system comprising:

a limb including an axle clearance hole extending axially therethrough;

an axle shaft extending through said axle clearance hole;

a bushing seated within said axle clearance hole for rotatably receiving said axle shaft therethrough; and a dampening member positioned and extending outwardly between said bushing and said limb for decoupling said axle shaft from said limb and dampening vibrational energy exerted through said axle shaft.

2. A suspension system as set forth in claim 1 wherein said axle clearance hole includes a recessed portion aligned axially therewith.

3. A suspension system as set forth in claim 2 wherein said bushing is a ball bearing.

4. A suspension system as set forth in claim 3 further including an interlocking hub having an interior cavity for receiving said ball bearing therewithin.

5. A suspension system as set forth in claim 4 wherein said interlocking hub is positioned within said recessed portion.

6. A suspension system as set forth in claim 5 wherein said interlocking hub includes a groove along an outer periphery thereof for receiving and interlocking said dampening member.

7. A suspension system as set forth in claim 6 wherein said dampening member is molded to said limb.

8. A suspension system as set forth in claim 7 wherein said dampening member is molded to said interlocking hub.

9. A suspension system as set forth in claim 8 wherein said dampening member is an elastomeric material.

10. A suspension system as set forth in claim 9 wherein said axle shaft includes a circular segment and a keyed segment.

11. A suspension system as set forth in claim 10 wherein said bushing is mounted along said circular segment of said axle shaft.

12. A suspension system as set forth in claim 11 wherein said interlocking hub includes an aperture axially aligned with said axle clearance hole for receiving said axle shaft therethrough.

13. A suspension system as set forth in claim 1 further including a first string extending from a first rotating member and a second string extending from a second rotating member.

14. A suspension system as set forth in claim 13 further including a shock absorber assembly interconnecting said first and second strings.

15. A suspension system as set forth in claim 14 wherein said shock absorber assembly includes a hollow elongated shock absorber and string hookups mounted within said shock absorber at opposing ends thereof for receiving said first and second strings.

16. A suspension system as set forth in claim 15 wherein said string hookup includes an internal channel therethrough for receiving said string.

17. A suspension system as set forth in claim 16 wherein said opposing ends of said shock absorber interlock said first and second strings.

18. A suspension system as set forth in claim 17 wherein said first and second strings are molded to said shock absorber.

19. A suspension system as set forth in claim 18 wherein said shock absorber stretches outwards at each of its opposing ends as said first and second strings are pulled away from one another to store and dissipate energy.

20. A suspension system as set forth in claim 19 wherein said shock absorber is formed from an elastomeric material.

21. A suspension system as set forth in claim 1 further including a rotating member rotatably mounted along said axle shaft.

22. A suspension system as set forth in claim 21 wherein said rotating member includes an internal chamber.

23. A suspension system as set forth in claim 22 including an inner housing positioned within said internal chamber.

24. A suspension system as set forth in claim 23 including a ball bearing housed within said inner housing.

25. A suspension system as set forth in claim 24 including dampening dowels extending between said inner housing and said rotating member for allowing actuation of said inner housing relative thereto.

26. A suspension system as set forth in claim 25 wherein each of said dampening dowels is secured to said rotating member.

27. A suspension system as set forth in claim 26 wherein said dampening dowels are formed from an elastomeric material.

28. A suspension system as set forth in claim 21 wherein said rotating member includes a plurality of string post hookups mounted therealong.

29. A suspension system as set forth in claim 28 including an outer ring having an outer string groove formed therearound.

30. A suspension system as set forth in claim 29 wherein said outer ring is coupled to at least one of said string post hookups.

31. A suspension system as set forth in claim 30 wherein said outer ring is formed from an elastomeric material.

32. A suspension system as set forth in claim 31 including an elastomeric member coupled to at least one of said string post hookups.

33. A suspension system as set forth in claim 21 wherein said rotating member includes an axle hole extending therethrough.

34. A suspension system as set forth in claim 33 including a bushing assembly including a bushing member and a dampening sleeve.

35. A suspension system as set forth in claim 34 wherein said bushing assembly is positioned within said axle hole of said rotating member.

36. A suspension system as set forth in claim 35 wherein said dampening sleeve extends between said bushing member and said rotating member for decoupling said axle shaft from said rotating member and for dampening vibrational energy exerted through said axle shaft.

37. A suspension system as set forth in claim 36 wherein said bushing member is a ball bearing.

38. A suspension system for dampening vibrational energy and noise in an archery bow, said suspension system comprising:

an axle shaft;

an inner bushing mounted along said axle shaft; and a dampening member molded to said inner bushing for dampening vibrational energy exerted through said axle shaft.

39. A suspension system as set forth in claim 38 further including an outer bushing extending radially around said inner bushing.

40. A suspension system as set forth in claim 39 wherein said outer and inner bushings define an interlocking passage therebetween.

41. A suspension system as set forth in claim 40 wherein said dampening member is positioned within said interlocking passage.

42. A suspension system as set forth in claim 41 wherein said outer and inner bushings lockingly engage said dampening member.

43. A suspension system as set forth in claim 42 wherein said dampening member is an elastomeric material.

44. A suspension system as set forth in claim 43 wherein said inner bushing is a ball bearing.

45. A suspension system for dampening noise and vibrational energy in an archery bow having a limb and a string, said suspension system comprising:

a rotating member adapted to be rotatably coupled to the limb of the archery bow, said rotating member defining a string groove adapted to receive and guide the string about said rotating member; and a dampening member seated within said string groove and secured thereto between said rotating member and the string for decoupling said rotating member from the string and dampening vibrational energy exerted on said rotating member.

46. A suspension system as set forth in claim 45 further including an axle shaft adapted to be coupled to the limb for rotatably supporting said rotating member thereabout.

47. A suspension system as set forth in claim 46 wherein said dampening member is molded to said rotating member.

48. A suspension system as set forth in claim 47 wherein said dampening member includes an inner interlocking rim for lockingly engaging said string groove of said rotating member.

49. A suspension system as set forth in claim 48 wherein said dampening member includes an outer string groove for receiving the string therealong.

50. A suspension system as set forth in claim 49 wherein said dampening member is formed from an elastomeric material.

* * * * *